US005892495A

United States Patent [19]

Sakai et al.

[11] Patent Number: 5,892,495

[45] Date of Patent: Apr. 6, 1999

[54] SCANNING CIRCUIT AND IMAGE DISPLAY APPARATUS

[75] Inventors: Tamotsu Sakai; Kenichi Katoh, both of Tenri; Yasushi Kubota, Sakurai, all of Japan

[73] Assignee: Sharp Kabushiki Kaisha, Osaka, Japan

[21] Appl. No.: 725,314

[22] Filed: Oct. 2, 1996

[30] Foreign Application Priority Data

Nov. 20, 1995 [JP] Japan ..... 7-301763

[51] Int. Cl.[6] ..... G09G 5/00

[52] U.S. Cl. ..... 345/98; 345/100; 345/204

[58] Field of Search ..... 345/87, 88, 92, 345/98, 99, 100, 204, 515, 193, 516, 517; 349/42, 41

[56] References Cited

U.S. PATENT DOCUMENTS

| | | | |
|---|---|---|---|
| 3,921,166 | 11/1975 | Volpe | 345/168 |
| 5,051,739 | 9/1991 | Hayashida et al. | 345/92 |
| 5,153,568 | 10/1992 | Shaw | 345/88 |

FOREIGN PATENT DOCUMENTS

| | | |
|---|---|---|
| 5-22917 | 3/1993 | Japan . |
| 5-70157 | 10/1993 | Japan . |
| 7-66252 | 7/1995 | Japan . |
| 7-66256 | 7/1995 | Japan . |

OTHER PUBLICATIONS

U.S. Application No. 08/363,217, Katoh et al., filed Dec. 23, 1994.

*Primary Examiner*—Lun-Yi Lao
*Attorney, Agent, or Firm*—Nixon & Vanderhye,, P.C.

[57] ABSTRACT

A scanning circuit is provided with a plurality of address lines and AND circuits. The address lines respectively supply bit signals constituting an address signal and inverted bit signals, and each AND circuit conducts a logical operation on a predetermined number of bit signals and inverted bit signals selected from the bit signals and inverted bit signals supplied from the address lines. The AND circuits are connected to the address lines so that only one bit is switched when the address signal carries. Furthermore, a frequency of the least significant bit of the address signal is set to ¼ of the dot frequency, while the two bits at the high end are set to have the same frequency and a phase difference of 90° each other. With the described arrangement, a phase shift is prevented from occurring to an outputted signal when the address signal carries. Furthermore, the arrangement ensures that the scanning circuit can be realized in a simple circuit arrangement and operates at low frequencies, thereby ensuring a decrease in power consumption.

46 Claims, 14 Drawing Sheets

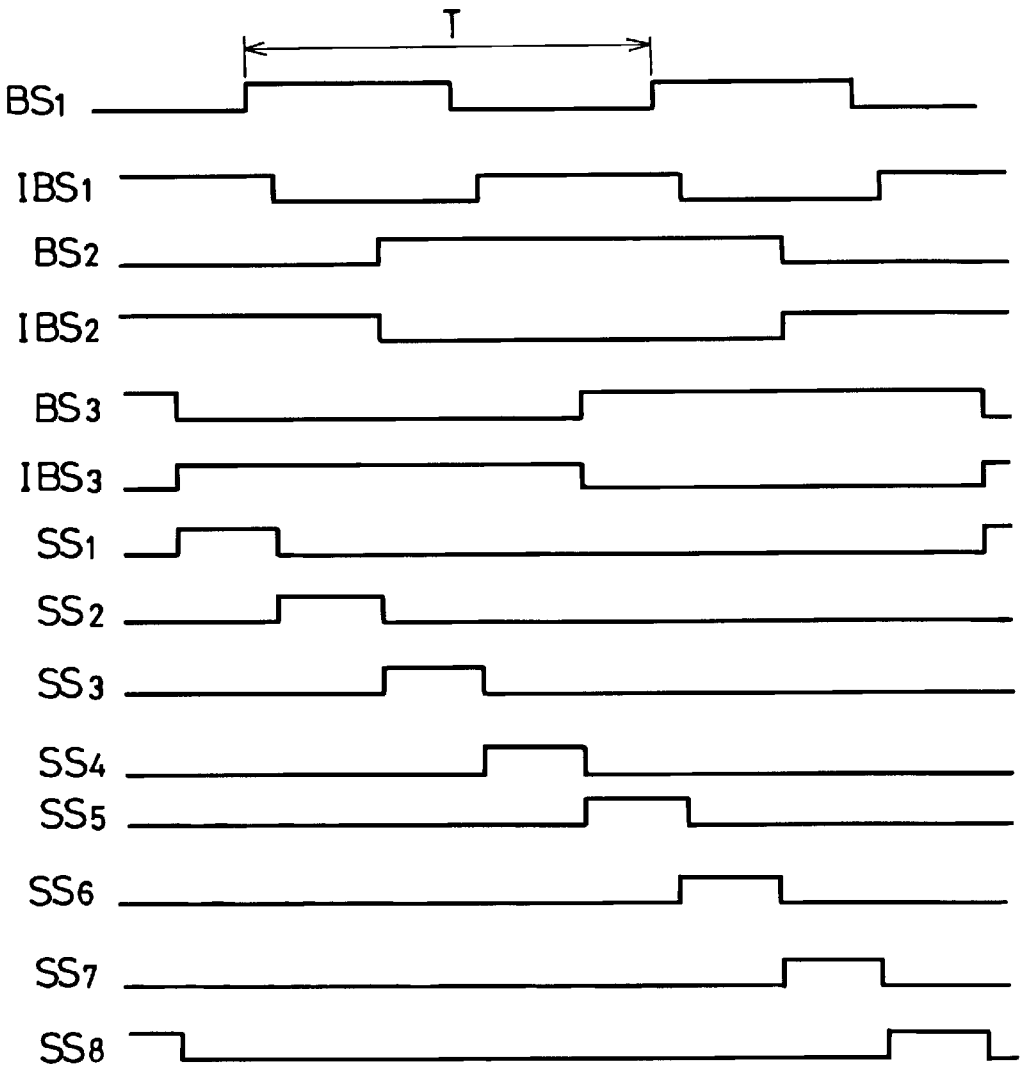
FIG.1(b-1)
FIG.1(b-2)
FIG.1(b-3)
FIG.1(b-4)
FIG.1(b-5)
FIG.1(b-6)
FIG.1(b-7)
FIG.1(b-8)
FIG.1(b-9)
FIG.1(b-10)
FIG.1(b-11)
FIG.1(b-12)
FIG.1(b-13)
FIG.1(b-14)

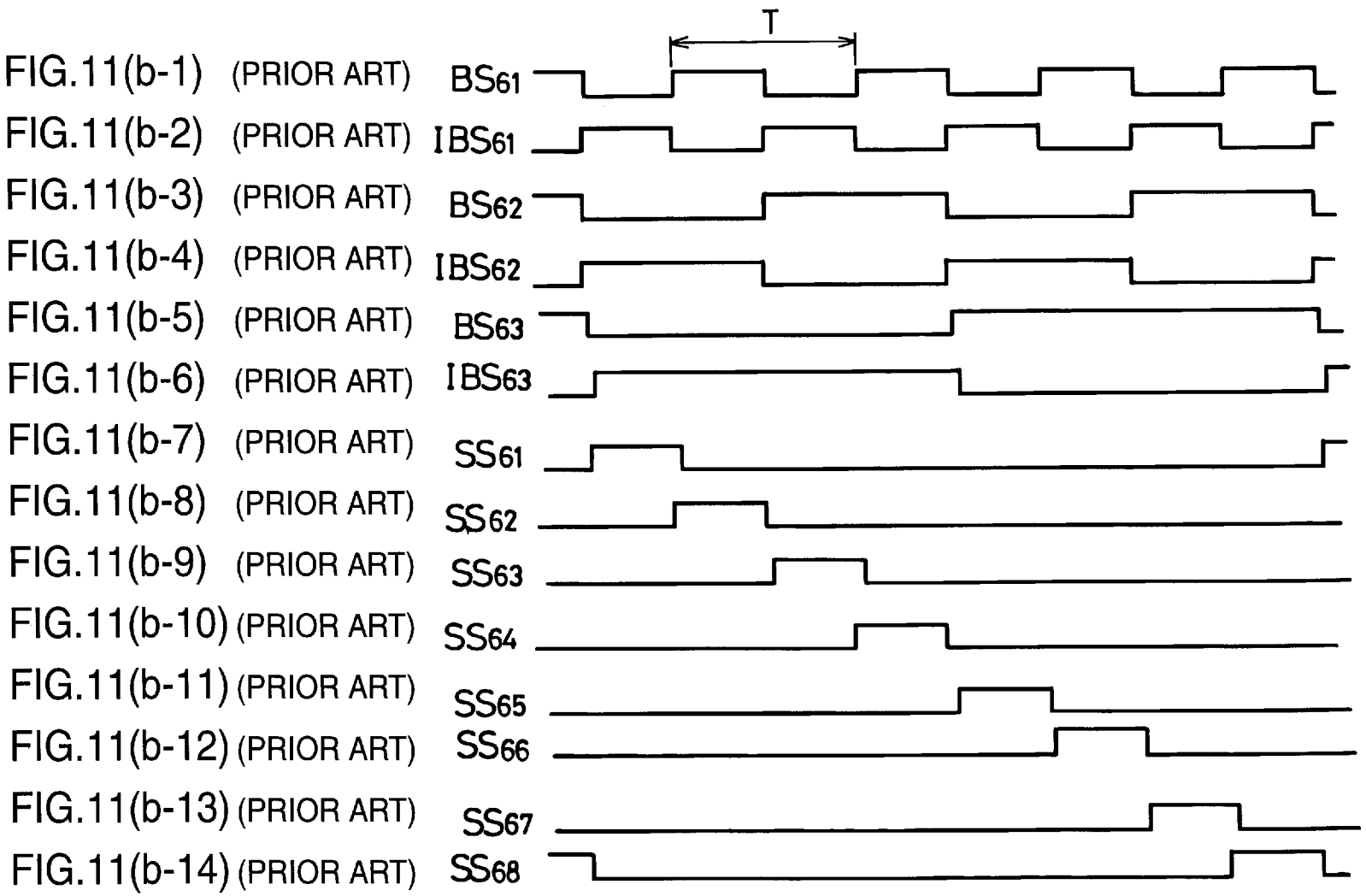
FIG.11(b-1) (PRIOR ART)
FIG.11(b-2) (PRIOR ART)
FIG.11(b-3) (PRIOR ART)
FIG.11(b-4) (PRIOR ART)
FIG.11(b-5) (PRIOR ART)
FIG.11(b-6) (PRIOR ART)
FIG.11(b-7) (PRIOR ART)
FIG.11(b-8) (PRIOR ART)
FIG.11(b-9) (PRIOR ART)
FIG.11(b-10) (PRIOR ART)
FIG.11(b-11) (PRIOR ART)
FIG.11(b-12) (PRIOR ART)
FIG.11(b-13) (PRIOR ART)
FIG.11(b-14) (PRIOR ART)

SCANNING CIRCUIT AND IMAGE DISPLAY APPARATUS

FIELD OF THE INVENTION

The present invention relates to a scanning circuit suitable for a driving circuit for driving a matrix-type display apparatus, and relates to an image display apparatus incorporating the scanning circuit.

BACKGROUND OF THE INVENTION

A matrix-type display apparatus includes a plurality of data lines to which picture signals are inputted, and a plurality of scanning lines provided so as to intersect the data lines so that the picture signals thus inputted to the data lines are scanned during each scanning period. At intersections of the data and scanning lines, there are provided pixels which carry out display in accordance with the picture signals supplied by the data lines. The pixels in whole are provided in a matrix form over the screen. Such a matrix-type display apparatus requires scanning signals issued by a scanning circuit so as to sample the inputted picture signals during one scanning period.

A conventional scanning circuit is provided with, for example, a shift register 51 and AND circuits $AG_{51}$ through $AG_{55}$, as shown in FIG. 8.

As shown in FIG. 9, clocked inverters 51*a* and 51*b* and an inverter 51*c* constitute a one-stage circuit, and a plurality of such circuits are cascaded, thereby constituting the shift register 51. The shift register 51 shifts a start pulse supplied by a pulse line PL, sequentially from one stage of the circuits to next, in response to a clock signal supplied by a clock line CKL. The start pulse thus supplied to each circuit is outputted through output lines $SOL_{51}$ through $SOL_{56}$ provided to the respective stages.

To be more concrete, as shown in FIG. 10, the start pulse STP is transferred to the stages one by one in synchronization with the clock signal CK, and is outputted through the output lines $SOL_{51}$ through $SOL_{56}$ as shift pulses $SP_{51}$ through $SP_{56}$, respectively. The shift pulses $S_{51}$, $S_{52}$, $S_{53}$, $S_{54}$, $S_{55}$, and $S_{56}$ are outputted in this order at the following timings: The odd-numbered shift pulses $SP_{51}$, $SP_{53}$, and $SP_{55}$ are outputted at timings in synchronization with rises of the clock signal CK, while the even-numbered shift pulses $SP_{52}$, $SP_{54}$, and $SP_{56}$ are outputted at timings in synchronization with falls of the clock signal CK.

Pairs of the output lines $SOL_{51}$ through $SOL_{56}$, one pair being composed of neighboring two output lines, are connected to the AND circuits $AG_{51}$ through $AG_{55}$, respectively. The two shift pulses are inputted to each of the AND circuits $AG_{51}$ through $AG_{55}$ through the respective two output lines, and each AND circuit AG conducts an AND operation on the two shift pulses. As a result, scanning signals $SS_{51}$ through $SS_{55}$ which have respective timings and the same pulse duration as that of the clock signal CK are outputted by the AND circuits $AG_{51}$ through $AG_{55}$ to output lines $OL_{51}$ through $OL_{55}$, respectively.

Another conventional scanning circuit is a decoder-type scanning circuit provided with, for example, as shown in FIG. 11(*a*), address lines $AL_{61}$ through $AL_{63}$, address lines $IAL_{61}$ through $IAL_{63}$, and AND circuits $AG_{61}$ through $AG_{68}$ which constitute a decoder.

As shown in FIG. 11(*b*), inputted to the address line $AL_{61}$ is a bit signal $BS_{61}$ with a cycle of T and a duty factor of 50 percent. Inputted to the address lines $AL_{62}$ and $AL_{63}$ are a bit signal $BS_{62}$ with a cycle of 2T and a bit signal $BS_{63}$ with a cycle of 4T, respectively. On the other hand, inputted to the address lines $IAL_{61}$ through $IAL_{63}$ are bit signals $IBS_{61}$ through $IBS_{63}$, respectively, which are obtained by inverting the bit signals $BS_{61}$ through $BS_{63}$.

The AND circuit $AG_{61}$ is connected to the address lines $IAL_{61}$ through $IAL_{63}$. The AND circuit $AG_{62}$ is connected to the address lines $AL_{61}$, $IAL_{62}$, and $IAL_{63}$. The AND circuit $AG_{63}$ is connected to the address lines $AL_{62}$, $IAL_{61}$, and $IAL_{63}$. The AND circuit $AG_{64}$ is connected to the address lines $AL_{61}$, $AL_{62}$, and $IAL_{63}$. The AND circuit $AG_{65}$ is connected to the address lines $AL_{63}$, $IAL_{61}$, and $IAL_{62}$. The AND circuit $AG_{66}$ is connected to the address lines $AL_{61}$, $AL_{63}$, and $IAL_{62}$. The AND circuit $AG_{67}$ is connected to the address lines $AL_{62}$, $AL_{63}$, and $IAL_{61}$. The AND circuit $AG_{68}$ is connected to the address lines $AL_{61}$ through $AL_{63}$.

The AND circuits $AG_{61}$ through $AG_{68}$ are thus supplied with three bit signals each, one combination of three bit signals constituting the address signal never being the same as another, and conduct AND operations on the address signal. As a result, a pulse with a pulse duration of T/2 is supplied, sequentially with a delay of T/2 each time, from the AND circuits $AG_{61}$ through $AG_{68}$ to output lines $OL_{61}$ through $OL_{68}$, respectively. Thus, scanning signals $SS_{61}$ through $SS_{68}$ shown in FIG. 11(*b*) are outputted. Combinations of binary values of the respective bits constituting the address signal to which the output timings of the pulse correspond are shown in Table 1 below.

TABLE 1

| ADDRESS SIGNAL | | | SCANNING |
|---|---|---|---|
| $BS_{61}$ | $BS_{62}$ | $BS_{63}$ | SIGNAL |
| 0 | 0 | 0 | $SS_{61}$ |
| 0 | 0 | 1 | $SS_{62}$ |
| 0 | 1 | 0 | $SS_{63}$ |
| 0 | 1 | 1 | $SS_{64}$ |
| 1 | 0 | 0 | $SS_{65}$ |
| 1 | 0 | 1 | $SS_{66}$ |
| 1 | 1 | 0 | $SS_{67}$ |
| 1 | 1 | 1 | $SS_{68}$ |

The following description will discuss comparison between two data line driving circuits for use in a matrix-type display apparatus, to which the above-described scanning circuits are respectively applied.

The clock signal inputted to the shift register and the least significant bit (bit signal $BS_{61}$) of the address signal inputted to the decoder are determined depending on a dot frequency $f_d$ respectively and have a frequency equivalent to half of the dot frequency $f_d$. Note that the dot frequency $f_d$ is a reciprocal of a period of time required for reading a quantity of data which is equivalent to one pixel of the matrix-type display apparatus.

The following description will discuss comparison between the two data line driving circuits about their consumption of power.

Given a frequency f, a load capacity C, and a power source voltage V, power consumption P is defined as $P=fCV^2$. Here, to simplify the calculation, the load capacity C is restricted to gate input capacities of transistors composing the respective scanning circuits.

In the data line driving circuit using the shift register, as shown in FIG. 12, the clocked inverters 51*a*, disposed on a line through which the start pulse STP is transferred, are equipped with an N-type transistor $T_{n51}$ and a P-type transistor $T_{p51}$ each, to which a clock signal CK and an inverted clock signal /CK are respectively inputted. Each stage of the circuits constituting the shift register 51 has two clocked inverters, namely, clocked inverters 51*a* and 51*b*.

Therefore, given that the transistors $T_{n51}$ and $T_{p51}$ have an input capacity $C_g$ each and that the shift register 51 has L outputs, the single clock line CKL has a load capacity $C_{sf}$ of $2LC_g$. In addition, the clock line CKL is actually composed of two signal lines for outputting the clock signal CK and the inverted clock signal /CK, respectively.

Accordingly, the power consumption $P_{sf}$ of the shift register 51 is obtained by the following equation:

$$\begin{aligned} P_{sf} &= (f_d/2)C_{sf}V^2 \times 2 \\ &= f_d C_{sf} V^2 \\ &= 2f_d L C_g V^2 \end{aligned}$$

wherein the frequency of the clock signal is $f_d/2$, as described above.

The data line driving circuit of the decoder type has a decoder actually composed of CMOS circuits. Therefore, instead of the AND circuits AG, either NAND circuits 52 (see FIG. 13) or NOR circuits (not shown), which execute logical operation similar to that by the AND circuits AG. Each NAND circuit 52 has pairs of an N-type transistor $T_{n52}$ and a P-type transistor $T_{p52}$, and the number of the pairs in one NAND circuit 52 corresponds to the number of address lines AL and IAL connected to one NAND circuit 52, that is, the number of inputs thereto. Note that the NAND circuit 52 shown in FIG. 13 is arranged so that two inputs are supplied to the NAND circuit 52.

Therefore, in the case where the NAND circuits 52 are connected to address lines AL at a rate of L/2 NAND circuits 52 per one address line AL, the total number of the transistors $T_{n52}$ and $T_{p52}$ connected to one address line AL is L. Accordingly, when the respective input capacities of the transistors $T_{n52}$ and $T_{p52}$ are defined as $C_g$ each, the load capacity $C_a$ per one address line AL is given as $LC_g$ ($=C_{sf}/2$).

The frequency of the least significant bit of the address signal is $f_d/2$, as described above. When the number of the provided address lines AL is m, the bits of the address signal are set so as to have frequencies $f_d/2$, $f_d/2^2$, $f_d/2^3$, $f_d/2^4$, . . . , $f_d/2^{m-2}$, $f_d/2^{m-1}$, $f_d/2^m$, from the least significant bit to the most significant bit. Furthermore, when the data line driving circuit has m address lines AL, it also has the same number m of address lines IAL to which the inverted clock signals are inputted. Therefore, the total number of the address lines AL and IAL is 2m.

Therefore, the power consumption $P_a$ of the decoder is obtained by the following equation:

$$\begin{aligned} P_a &= (f_d/2 + f_d/2^2 + f_d/2^3 + \ldots + \\ &\quad f_d/2^{m-2} + f_d/2^{m-1} + f_d/2^m)C_a V^2 \times 2 \\ &\approx 2f_d C_a V^2 = P_{sf} \end{aligned}$$

Thus, the power consumption of the data line driving circuit of the decoder type is substantially the same as that of the data line driving circuit of the shift register type.

Comparison is made between the two data line driving circuits about scanning speed, in the following description.

In the case with the data line driving circuit of the shift register type, a signal is subsequently transferred from one stage to another in the shift register 51, wherein an input signal to one stage is supplied by its previous stage. Therefore, the input signal has been affected by delay or rounding of the waveform which has been caused in the previous stages. In addition, an operational speed is affected by respective driving capacities of the individual transistors, the output signal from the previous stages, and input capacities of the following stages. Furthermore, a period while the P-type transistor and the N-type transistor in each inverter are simultaneously in the ON state is prolonged due to the rounding of the signal waveform. Such phenomena cause a current to increase, thereby increase the power consumption.

In the data line driving circuit of the decoder type, the address signal is directly inputted from the respective address lines AL to the corresponding logical circuits in the decoder. Therefore, the address signal is not affected by other circuits. Furthermore, whereas each stage of the shift register 51 is connected to two circuit systems, namely, the following stage and an output buffer (not shown), each logical circuit of the decoder is connected only to a buffer so as to supply an output thereto. Accordingly, one logical circuit of the decoder has an input load of a following stage, which is only half of that of one stage of the shift register, thereby having a higher operating speed.

Since the input load (capacity) of the following stage for the decoder is half of that of the shift register 51 as mentioned above, the decoder has less rounding of the signal waveform compared with the shift register. Accordingly, the current of the decoder is smaller than that of the shift register 51. Therefore, the decoder is superior in the power consumption as well.

In addition, the data line driving circuit of the decoder type is superior in the yield, as described below.

The data line driving circuit of the shift register type presents a problem pointed out in the Japanese Laid-open Patent Publication 7-191636/1995. Each stage of a shift register has 10 transistors, and each AND circuit thereof has 6 transistors, for example. Therefore, one data line driving circuit is composed of a large number of transistors. This leads to a low non-defective ratio of the data line driving circuit of the shift register type. In addition, in the case where the data line driving circuit and a display panel are integrally provided by using polycrystalline silicon, this leads to a problem that a ratio of non-defective operation of transistors further decreases due to dispersion in characteristics, electrostatic breakdown, etc.

In contrast, since the data line driving circuit of the decoder type has less transistors per one output, as described in the foregoing publication, it has a non-defective ratio higher than that of the data line driving circuit of the shift register type.

As has been described, the data line driving circuit of the decoder type is superior to the data line driving circuit of the shift register type in practical application.

Regarding the scanning circuit of the decoder type described above, an output is selected according to the combinations of the binary values of the bits constituting the address signal, as shown in FIG. 11(*b*). When the address signal carries, sometimes plural bits among those constituting the address signal are simultaneously switched, for example, from "011" to "100", as shown in Table 1. Such a switching tends to cause phase shift due to delays of the address signal or the like, thereby resulting in glitches.

In the case where the scanning circuit of the decoder type is applied to a data line driving circuit for use in a matrix-type display apparatus, frequencies of the address signal to be inputted to the decoder are determined depending on a dot frequency $f_d$ in accordance with the standard of the image display apparatus. For example, concerning a VGA (video graphics array)-standard image display apparatus, a frequency $f_a$ of a least significant bit of the address signal to be supplied to the decoder is obtained by the following equation, in consideration of a blanking period:

$$f_a = 800\ (H) \times 525\ (V) \times 60\ (Hz) \div 2 = 12.6\ (MHz)$$

wherein H represents the number of dots in a horizontal direction, and V represents the number of dots in a vertical direction.

Models of image display apparatuses have recently been diversified, while there has been an increasing demand for higher display quality of the image display apparatuses. To cope with such a demand, application of higher frequencies to driving circuits for use in data line driving circuits has been attempted. For example, in the case with a matrix-type display apparatus of an XGA (extended graphics array) standard, with the least significant bit of the address signal to be supplied to a decoder provided in a driving circuit is required to have a frequency of around 40 MHz. Since the power consumption is given as $P=fCV^2$, as described above, it increases in proportion to the frequency. Thus, the frequency greatly affects the power consumption.

On the other hand, there has also been an increasing demand for a matrix-type display apparatus consuming less power, and technical innovation has been promoted so as to meet the demand.

The address signal inputted to the decoder changes in the highest frequencies in those used in the scanning circuit of the image display apparatus. Furthermore, as described above, since the address lines are connected to the logical circuits at a rate of L/2 logical circuits per one address line, the address lines have a great input load capacity each. Power consumption due to the input load capacity accounts for a considerable part of the total power consumption of the data line driving circuit. Therefore, reduction in the power consumption by input members for inputting to the decoder is an important task so as to achieve reduction in the power consumption of the data line driving circuit.

Moreover, the following problem has been presented in the case where a display panel and a driving circuit are integrally formed by using polycrystalline silicon thin film transistors: for example, as mentioned in the Japanese Examined Patent Publication No. 5-22917/1993, a mobility of carriers in the silicon thin film is a fraction of carriers in silicon monocrystals. Furthermore, since refinement of the apparatus and improvement of process for such refined apparatus has been delaying, a limit of an operational speed of the polycrystalline silicon film transistor is lower than one several tenth of that of a conventional integrated circuit.

A conventional image display apparatus provided with a driver which is realized by an integrated circuit for an exclusive use as a driver does not have such a problem as described above, thereby being driven by a single driver system. In contrast, the scanning circuit exhibits a low operational speed, in the case where the foregoing scanning circuit is adapted to a data line driving circuit (driver) which is built in an active matrix substrate in a matrix-type image display apparatus with a high resolution. Therefore, the data line driving circuit is required to have a plurality of driver systems, so as to solve the problem of the low operational speed.

This stems from that the transistors are affected by variations of characteristics of the circuit, in addition to that the individual transistors each have a low driving capacity. Therefore, a scanning circuit which can be operated at lower frequencies has been sought for.

SUMMARY OF THE INVENTION

The object of the present invention is to provide a decoder-type scanning circuit which can optimize an address signal thereby avoiding a phase shift occurring to an output signal when the address signal carries. Another object of the present invention is to provided a decoder-type scanning circuit realized in a simple circuit arrangement which operates at low frequencies thereby consuming less power.

To achieve the above objects, a scanning circuit of the present invention comprises:

m address lines for respectively supplying bit signals, each bit signal being indicative of each bit of an address signal; and a decoder for conducting logical operations on the address signal having m bits so as to sequentially output L ($L \leqq 2^m$) scanning signals, wherein each bit of the address signal is associated with the address lines so that only one bit of the address signal is switched each time when the address signal carries.

With the described arrangement of the scanning circuit, only one bit of the address signal is switched each time when the address signal carries, thereby causing substantially no phase shift resulting from delays of the address signal or the like. Therefore, it is possible to prevent glitches.

The foregoing scanning circuit is preferably arranged so as to satisfy the following condition (a) or (b).

(a) The bit signal indicative of the least significant bit of the address signal has a frequency of ¼ of a dot frequency, the dot frequency being a reciprocal of a period of time required for reading in data corresponding to each pixel, and the bit signals, indicative of the two bits at the high end respectively, have a same frequency and a phase difference of 90° from one another. This is one of the typical arrangements of the address signal which ensure that the condition on the association of the respective bits of the address signal with the address lines is satisfied.

With the described arrangement, since the frequency of the bit signal indicative of the least significant bit of the address signal is set to ¼ of the dot frequency, the frequencies for the address signal, that is, the frequencies at which the scanning circuit operates are lowered. When power consumption of the foregoing scanning circuit is calculated in the same manner as the case with the above-described conventional decoder-type scanning circuit, the result is drastically lower than that of the conventional case. This shows that the foregoing arrangement ensures the reduction of the power consumption of the scanning circuit.

(b) The foregoing scanning circuit further comprises first and second sampling circuits for respectively sampling first and second picture signals constituting an original picture signal in response to the scanning signals supplied from the decoder, one pair of the first and second sampling circuits being provided per one scanning signal output line.

With this arrangement, in the scanning circuit wherein the original picture signal is divided and sampled, a period of time required for one sampling operation by the first and second sampling circuit is longer than a period of time required for one sampling operation in a scanning circuit wherein the whole original picture signal is sampled. Therefore, frequencies for the scanning signals can be lowered in the scanning circuit in accordance with the foregoing arrangement, thereby resulting in that the frequencies at which the scanning circuit operates can be lowered.

Moreover, the scanning circuit arranged so as to satisfy the condition (a) or (b) is preferably composed of thin film transistors. To be more specific, in the scanning circuit having the first and second sampling circuits, the decoder and the first and second sampling circuits are composed of the thin film transistors. In the scanning circuit without the first and second sampling circuits, the decoder is composed of the thin film transistors. Such a scanning circuit, having an address signal with lower frequencies as described above, can have requisite operating characteristics even though being realized by thin film transistors having operating characteristics inferior to those of transistors on a monocrystalline silicon substrate, for example, realized by polycrystalline silicon thin film transistors.

So as to achieve the above-described object, an image display apparatus of the present invention comprises:

pixel electrodes for supplying a picture signal to pixels provided in a matrix form;

a plurality of data lines for supplying the picture signal to the pixel electrodes;

a plurality of scanning lines orthogonally crossing the data lines so as to sequentially select the pixel electrodes to be supplied with the picture signal;

a data line driving circuit for outputting the picture signal to the data lines; and a scanning line driving circuit for outputting a selection signal, wherein at least either the data line driving circuit or the scanning line driving circuit includes a scanning circuit, the scanning circuit including:

m address lines for respectively supplying bit signals, each bit signal being indicative of each bit of an address signal; and a decoder for conducting logical operations on the address signal having m bits so as to sequentially output L scanning signals ($L \leqq 2^m$), each bit of the address signal being associated with the address lines so that only one bit of the address signal is switched each time when the address signal carries.

The image display apparatus thus arranged can execute stable display operations, since it is possible to prevent glitches in the scanning circuit from occurring.

The image display apparatus also can achieve a decrease in power consumption, by installing the scanning circuit which satisfies the above-mentioned condition (a) or (b) thereby having lower frequencies at which the scanning circuit operates.

Another image display apparatus of the present invention comprises:

pixel electrodes for supplying a picture signal to pixels provided in a matrix form;

a plurality of data lines for supplying the picture signal to the pixel electrodes;

a plurality of scanning lines orthogonally crossing the data lines so as to sequentially select the pixel electrodes to be supplied with the picture signal;

a data line driving circuit for outputting the picture signal to the data lines, the data line driving circuit including a scanning circuit, the scanning circuit including m address lines and a decoder, the address lines respectively supplying bit signals, each bit signal being indicative of each bit of an address signal, a decoder conducting logical operations on the address signal having m bits so as to sequentially output L ($L \leqq 2^m$) scanning signals, the decoder being composed of thin film transistors, each bit of the address signal being associated with the address lines so that only one bit of the address signal is switched each time when the address signal carries;

a scanning line driving circuit for outputting a selection signal to the scanning line; and switching elements for outputting the picture signal supplied from the data lines to the pixel electrodes in accordance with the selection signals supplied to the scanning lines;

wherein the pixel electrodes, the switching elements, and the data line driving circuit are provided on either an amorphous silicon thin film, a polycrystalline silicon thin film, or a monocrystalline silicon thin film, formed on an insulating substrate.

In the image display apparatus thus arranged, the pixels and the driving circuits are integrally provided on the insulating substrate. On such an insulating substrate, thin film transistors provided on the amorphous silicon thin film, the polycrystalline silicon thin film, or the monocrystalline silicon thin film have operating characteristics inferior to those of transistors provided on a monocrystalline silicon substrate. However, since the data line driving circuit incorporates the above-described scanning circuit which has low operational frequencies, the data line driving circuit can be composed of thin film transistors having inferior characteristics. Therefore, an image display apparatus provided with an active matrix substrate of a driver built-in type, which is composed of such thin film transistors, can be easily obtained.

For fuller understanding of the nature and advantages of the invention, reference should be made to the ensuing detailed description taken in conjunction with the accompanying drawings.

BRIEF DESCRIPTION OF THE DRAWINGS

FIG. 1(*b*) is a timing chart illustrating operations of the scanning circuit.

FIG. 2(*b*) is a circuit diagram illustrating a detailed arrangement of a pixel of the active matrix-type liquid crystal display apparatus.

FIG. 4(*b*) is a timing chart illustrating operations of the scanning circuit shown in FIG. 4(*a*)

FIG. 11(*b*) is a timing chart illustrating operations of the scanning circuit shown in FIG. 11(*a*).

DESCRIPTION OF THE PREFERRED EMBODIMENTS

First Embodiment

The following description will discuss one embodiment of the present invention, with reference to FIGS. 1 through 6.

Figure 2:
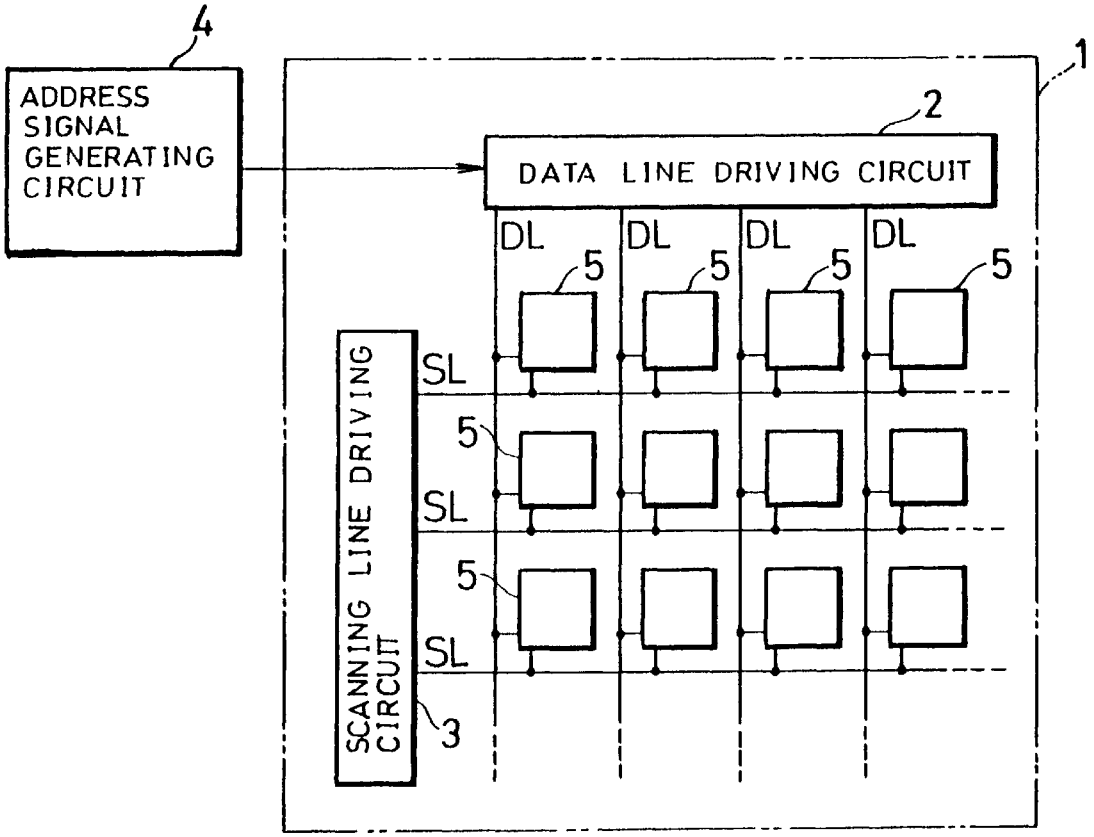
FIG. 2(*a*) is a block diagram illustrating an arrangement of principal parts of an active matrix-type liquid crystal display apparatus incorporating the scanning circuit.
Figure 2:
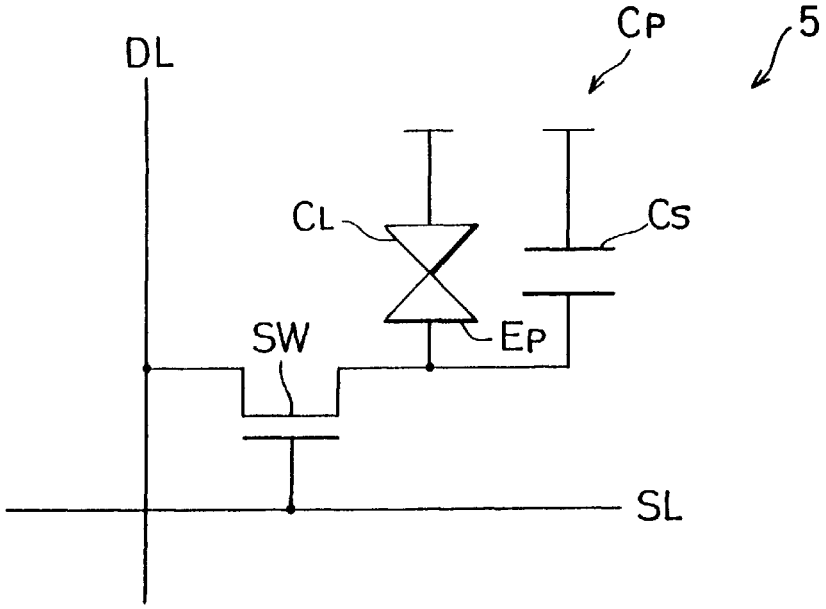

A matrix-type image display apparatus in accordance with the present embodiment is an active-matrix type liquid crystal display apparatus, which has, as shown in FIG. 2(*a*), a liquid crystal panel 1 provided with a plurality of data lines DL and a plurality of scanning lines SL, a data line driving circuit 2, a scanning line driving circuit 3, and an address signal generating circuit 4. The liquid crystal panel 1 is composed of two glass substrates stuck to each other and liquid crystal filled therebetween.

On the liquid crystal panel 1, the data lines DL and the scanning lines SL are orthogonally provided. Each area closed by two neighboring data lines DL and two neighboring scanning lines SL has a pixel 5. Therefore, the pixels 5 are provided in a matrix form in whole.

As shown in FIG. 2(*b*), each pixel 5 is composed of a switching element SW which is a field effect transistor (thin film transistor), and a pixel capacitor $C_P$. The pixel capacitor $C_P$ has a liquid crystal capacitor $C_L$, and a supplemental capacitor $C_S$ which is used when necessary.

The data line DL and an electrode of the pixel capacitor $C_P$, that is, a pixel electrode $E_P$, are connected through a source and a drain of the switching element SW. A gate of the switching element SW is connected to the scanning line SL, and the other electrode of the pixel capacitor $C_P$ is a common electrode which is shared by all the pixels 5. Transmittance or reflectance of the liquid crystal are modulated in accordance with voltages applied to the respective liquid crystal capacitors $C_L$ so as to carry out display.

The data line driving circuit 2 sequentially selects picture signals inputted thereto during a period of a predetermined duration and supplies the picture signals to the data lines DL, while the data line driving circuit 2 has a scanning circuit which will be described later. The scanning line driving circuit 3 sequentially selects the scanning lines SL, and controls the closing and opening of the respective switching elements SW in the pixels 5.

The switching element SW in the active matrix-type liquid crystal display apparatus of the present embodiment is a thin film transistor. The thin film transistors constituting the switching elements SW are provided on either an amorphous silicon thin film, a polycrystalline silicon thin film, or a monocrystalline silicon thin film, formed on a glass substrate of the liquid crystal panel 1. The data line driving circuit 2 and the scanning line driving circuit 3 are monolithically provided, together with the switching elements SW and the pixel electrodes $E_P$, on the same glass substrate. The data line driving circuit 2 and the scanning line driving circuit 3 are also composed of thin film transistors similar to those for the switching elements SW.

The following description will discuss the scanning circuit provided in the data line driving circuit 2.

The scanning circuit is provided with m address lines $AL_l$ through $AL_m$ and m address lines $IAL_l$ through $IAL_m$, and L AND circuits $AG_1$ through $AG_L$ ($L \leqq 2^m$) constituting a decoder 6.

Note that m=3 and L=8 in the scanning circuit of the present embodiment, so as to simplify explanation. In addition, in the following description, the address lines $AL_1$ through $AL_3$ and the address lines $IAL_1$ through $IAL_3$ are referred to simply as address lines AL and address lines IAL, respectively, unless individual lines are referred to. Likewise, the bit signals $BS_1$ through $BS_3$ and $IBS_1$ through $IBS_3$ are referred to as bit signals BS and IBS.

Figure 1:
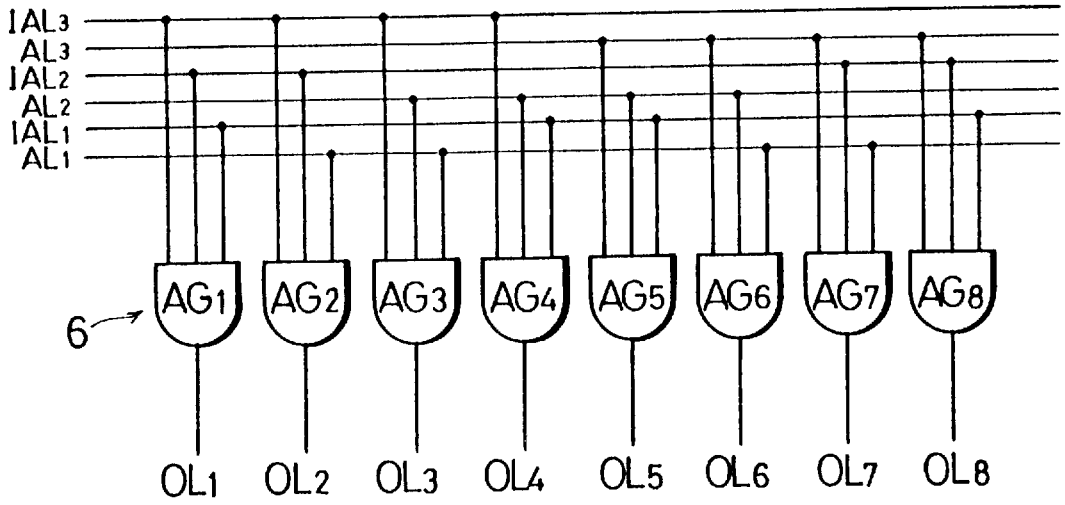
FIG. 1(*a*) is a circuit diagram illustrating an arrangement of principal parts of a scanning circuit in accordance with the first embodiment of the present invention.

As shown in FIG. 1(*b*), supplied to the address line $AL_1$ is the bit signal $BS_1$ which has a constant cycle of T and a duty factor of 50 percent. The bit signal $BS_1$ is the least significant bit of a signal supplied to the decoder 6, and has a frequency of ¼ of the dot frequency. The bit signals BS and IBS are issued by the address signal generating circuit 4 shown in FIG. 2(*a*).

On the other hand, supplied to the address line $AL_2$ is the bit signals $BS_2$ which has a cycle of 2T and has a phase difference of 90° to the bit signal $BS_1$. Supplied to the address line $AL_3$ is the bit signal $BS_3$ which has a cycle of 2T and has a phase difference of 90° to the bit signal $BS_2$.

Furthermore, supplied to the address lines $IAL_1$ through $IAL_3$ are the bit signals $IBS_1$ through $IBS_3$, respectively, which are signals obtained by inverting the bit signals $BS_1$ through $BS_3$. An address signal has bits which respectively correspond to bit signals $BS_1$ through $BS_3$. The bit signals $BS_1$ and $BS_3$ are the least and most significant bits, respectively, in the address signal.

The AND circuit $AG_1$ is connected to the address lines $IAL_1$ through $IAL_3$.The AND circuit $AG_2$ is connected to the address lines $AL_1$, $IAL_2$, and $IAL_3$. The AND circuit $AG_3$ is connected to the address lines $AL_1$, $AL_2$, and $IAL_3$. The AND circuit $AG_4$ is connected to the address lines $AL_2$, $IAL_1$, and $IAL_3$. The AND circuit $AG_5$ is connected to the address lines $AL_2$, $AL_3$, and $IAL_1$. The AND circuit $AG_6$ is connected to the address lines $AL_1$ through $AL_3$. The AND circuit $AG_7$ is connected to the address lines $AL_1$, $AL_3$, and $IAL_2$. The AND circuit $AG_8$ is connected to the address lines $AL_3$, $IAL_1$, and $IAL_2$.

The AND circuits $AG_i$ through $AG_8$ are thus supplied with three bit signals each, which are selected among the bit signals BS and IBS and the combination of which is not same as any other, and each circuit conducts an AND operation on the inputted three bit signals. The respective AND circuits $AG_i$ through $AG_8$ are realized by CMOS (complementary metal-oxide semiconductor) circuits. To be more concrete, they are composed of NAND circuits and inverters. Alternatively, NOR circuits composed of CMOS may substitute for AND circuits $AG_i$ through $AG_8$.

In the scanning circuit arranged as above, the bit signals BS and IBS of FIG. 1(*b*) are supplied to the AND circuits $AG_i$ through $AG_8$ through the address lines AL and IAL. Then, as shown in FIG. 1(*b*), scanning signals $SS_1$ through $SS_8$ are outputted from the AND circuits $AG_i$ through $AG_8$ to the output lines $OL_1$ through $OL_8$. The scanning signals $SS_1$ through $SS_8$ are pulses with a pulse duration of T/4 each, which sequentially rise with a delay of the pulse duration T/4 each, so that the pulses do not overlap one another.

The bit signal $BS_1$ (the least significant bit) has a frequency of ¼ of the dot frequency $f_d$ at which the pulse is outputted as described above, that is, a frequency $f_d/4$. The bit signal $BS_2$ (the second bit) and the bit signal $BS_3$ (the most significant bit) respectively have a frequency $f_d/8$, which is equivalent to ½ of the frequency of the bit signal $BS_1$, and have a phase difference of 90° one another.

Table 2 below shows combinations of the binary values of the bits constituting the address signal, which correspond to the respective scanning signals $SS_1$ through $SS_8$. It is arranged that only one bit signal is switched, each time the address signal carries.

TABLE 2

| ADDRESS SIGNAL | | | SCANNING |
|---|---|---|---|
| $BS_3$ | $BS_2$ | $BS_1$ | SIGNAL |
| 0 | 0 | 0 | $SS_1$ |
| 0 | 0 | 1 | $SS_2$ |
| 0 | 1 | 1 | $SS_3$ |
| 0 | 1 | 0 | $SS_4$ |
| 1 | 1 | 0 | $SS_5$ |
| 1 | 1 | 1 | $SS_6$ |
| 1 | 0 | 1 | $SS_7$ |
| 1 | 0 | 0 | $SS_8$ |

The following description will discuss a scanning circuit in the case where m=4 and L=6.

Table 3 shows combinations of binary values of bits constituting an address signal in the above case, the combinations corresponding to respective scanning signals, though no concrete circuit arrangement is shown. In this case, 16 scanning signals $SS_1$ through $SS_{16}$ are outputted in accordance with the address signal having 4 bits (bit signals $BS_1$ through $BS_4$). In this scanning circuit it also, it is arranged that only one bit is switched each time when the address signal carries.

| ADDRESS SIGNAL | | | | SCANNING |
|---|---|---|---|---|
| $BS_4$ | $BS_3$ | $BS_2$ | $BS_1$ | SIGNAL |
| 0 | 0 | 0 | 0 | $SS_1$ |
| 0 | 0 | 0 | 1 | $SS_2$ |
| 0 | 0 | 1 | 1 | $SS_3$ |
| 0 | 0 | 1 | 0 | $SS_4$ |
| 0 | 1 | 1 | 0 | $SS_5$ |
| 0 | 1 | 1 | 1 | $SS_6$ |
| 0 | 1 | 0 | 1 | $SS_7$ |
| 0 | 1 | 0 | 0 | $SS_8$ |
| 1 | 1 | 0 | 0 | $SS_9$ |
| 1 | 1 | 0 | 1 | $SS_{10}$ |
| 1 | 1 | 1 | 1 | $SS_{11}$ |
| 1 | 1 | 1 | 0 | $SS_{12}$ |
| 1 | 0 | 1 | 0 | $SS_{13}$ |
| 1 | 0 | 1 | 1 | $SS_{14}$ |
| 1 | 0 | 0 | 1 | $SS_{15}$ |
| 1 | 0 | 0 | 0 | $SS_{16}$ |

The bit signal $BS_1$ (the least significant bit) has a frequency of ¼ of the dot frequency $f_d$, namely, a frequency $f_d/4$. The bit signal $BS_2$ (the second bit) has a frequency $f_d/8$, which is equivalent to ½ of the frequency of the bit signal $BS_1$. The bit signal $BS_3$ (the third bit) and the bit signal $BS_4$ (the most significant bit) have a frequency $f_d/16$ each, which is equivalent to ¼ of the frequency of the bit signal $BS_1$, and have a phase difference of 90° one another.

Thus, irrelevant to what number the "m" takes, the scanning circuit is arranged as described below:

(1) only one bit is switched each time when the address signal carries;

(2) the least significant bit has a frequency of ¼ of the dot frequency; and (3) the two bits at the high end have the same frequency, and have a phase difference of 90° one another.

With the arrangement described in the item (1), glitches can be prevented, since it no longer happens that plural bits in those constituting the address signal are switched at once when the address signal carries. This ensures that the scanning circuit stably operates. With the arrangements described in the items (2) and (3), reduction of the power consumption can be achieved as described below.

In the case where the number of the address lines is m, bits (bit signals) of the address signal from the least significant bit to the most significant bit have frequencies $f_d/2^2$, $f_d/2^3$, $f_d/2^4 \ldots$, $f_d/2^{m-1}$, $f_d/2^m$, and $f_d/2^m$, respectively.

Since (1) the load capacity $C_{a2}$ per one address line of the address lines AL and IAL is the same as the load capacity $C_a$ per one address line of a conventional scanning circuit of the decoder type and (2) the scanning circuit has m address lines AL and the same number of the address lines IAL, the power consumption $P_{a2}$ of the scanning circuit is given as:

$$\begin{aligned} P_{a2} &= (f_d/2^2 + f_d/2^3 + f_d/2^4 + \ldots + \\ &\quad f_d/2^{m-1} + f_d/2^m + f_d/2^m)C_{a2}V^2 \times 2 \\ &\approx f_d C_{a2} V^2 = P_a/2 \end{aligned}$$

Namely, the scanning circuit of the present embodiment consumes power equivalent to half of that consumed by the conventional scanning circuit.

Figure 3:
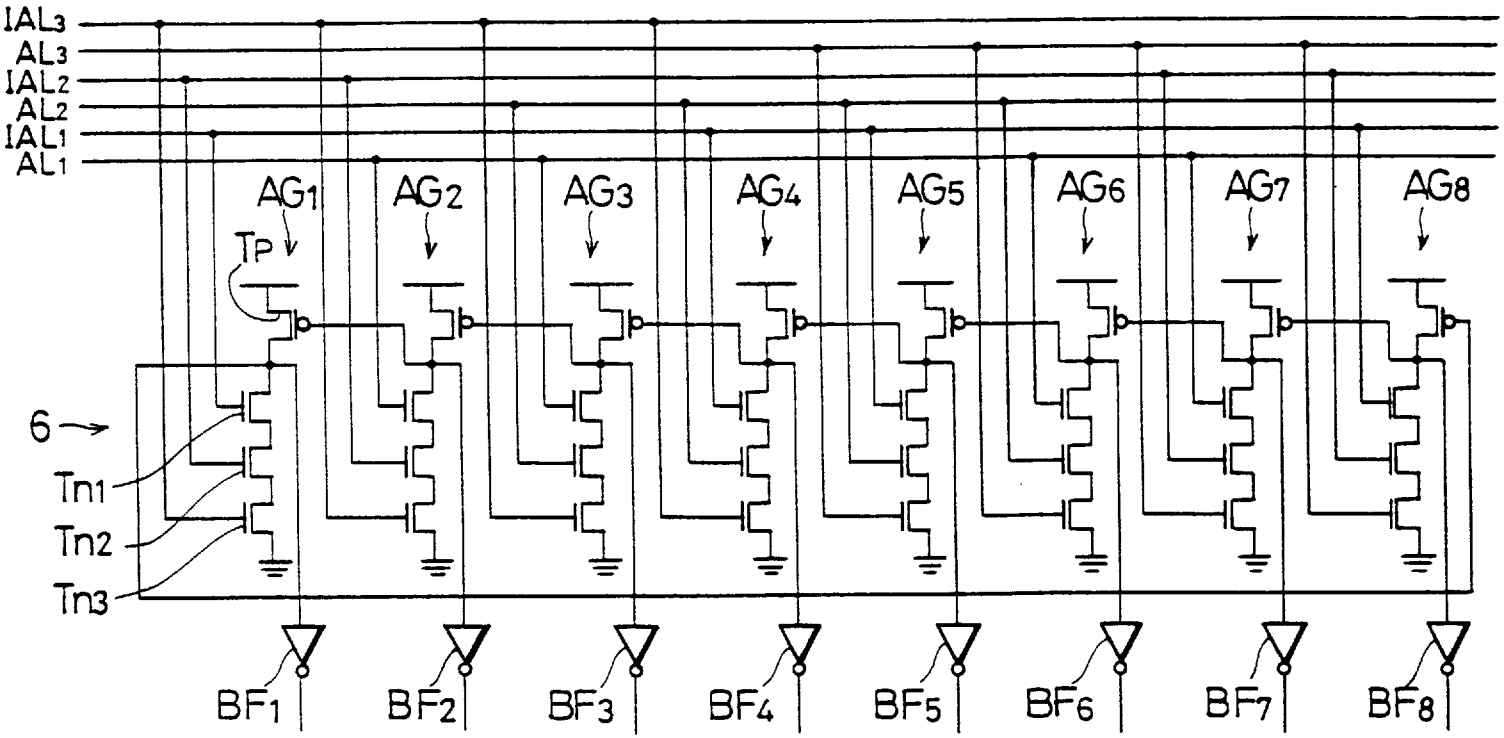
FIG. 3 is a circuit diagram illustrating an arrangement of principal parts of another scanning circuit in accordance with the first embodiment of the present invention.
Figure 4:
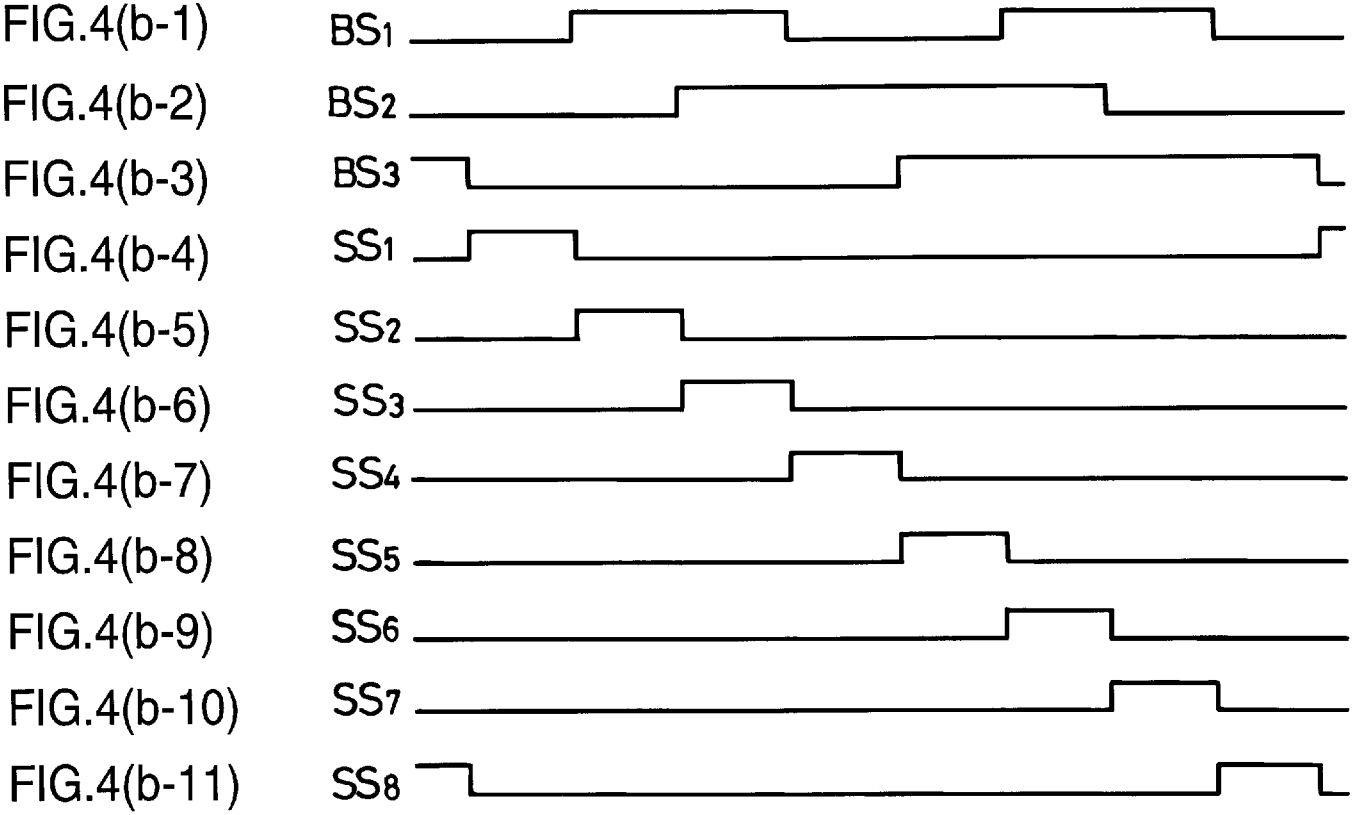

Note that the decoder 6 in the scanning circuit of the present embodiment, which is composed of the AND circuits $AG_i$ through $AG_8$, may be a dynamic type as shown in FIG. 3, instead of being realized by the foregoing CMOS circuits. Each of AND circuits $AG_i$ through $AG_8$ of the dynamic-type decoder 6 is composed of a P-type transistor $T_p$ and three transistors $T_{n1}$ through $T_{n3}$ which are connected in series. The P-type transistor $T_p$ is for resetting, while the transistors $T_{n1}$ through $T_{n3}$ are respectively connected to the address lines AL and IAL.

In each AND circuit AG, the transistor $T_{n1}$ and the transistor $T_p$ are connected to each other at a node, and the node is connected to a gate of a transistor $T_p$ of an AND circuit AG of the previous stage while the node is also connected to a buffer BF. Note that the node of the AND circuit of the first stage, namely, AND circuit $AG_i$, is connected to the gate of the transistor $T_p$ of the AND circuit of the last stage, namely, the AND circuit $AG_8$.

The decoder 6 arranged as described above operates as follows.

An AND circuit $AG_i$ of a certain stage outputs a "LOW" (ON) signal, when it is supplied with an address signal having a combination of bit values which causes all the transistors $T_{n1}$ through $T_{n3}$ to become in the ON state. Then, an AND circuit $AG_{i+1}$ of the following stage outputs a "LOW" (ON) signal, due to a change occurring to the bit value combination in the address signal. In this state, one of the transistors $T_{n1}$ through $T_{n3}$ of the AND circuit $AG_i$ becomes in the OFF state, thereby causing the AND circuit $AG_i$ composed of the transistors $T_{n1}$ through $T_{n3}$ to become in the OFF state.

Since the AND circuit $AG_{i+1}$ outputs a "LOW" (ON) signal, the transistor $T_p$ of the AND circuit $AG_i$ is supplied with the "LOW" (ON) signal and becomes in the ON state. This causes the AND circuit $AG_i$ to output a "HIGH" (OFF) signal.

Thus, the decoder 6 of the dynamic type can execute a scanning operation as the decoder of the CMOS type does.

Furthermore, whereas one address line is connected to the respective gates of P-type and N-type transistors in the decoder of the CMOS type, one address line is connected only to the respective gates of the N-type transistors $T_{n1}$ through $T_{n3}$ in the decoder of the dynamic type. Therefore, each AND circuit of the decoder 6 of the dynamic type has an input gate capacity of ½ of that of the decoder of the CMOS type. As a result, the decoder of the dynamic type consumes ½ power.

Figure 4:
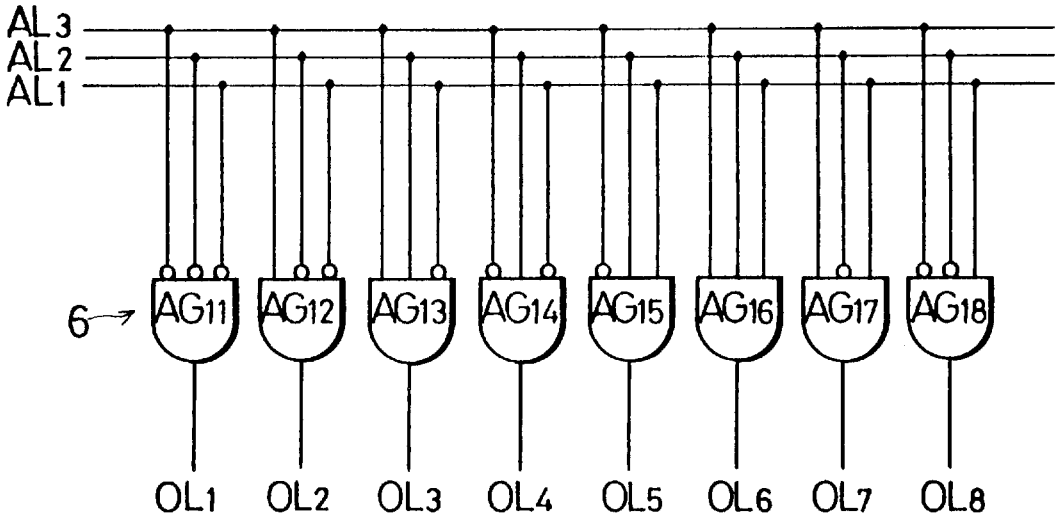
FIG. 4(*a*) is a circuit diagram illustrating an arrangement of principal parts of still another scanning circuit in accordance with the first embodiment of the present invention.

In the scanning circuit in accordance with the present embodiment, the address lines IAL may be omitted, as shown in FIG. 4(*a*). In this case, respective signals supplied to the three address lines $AL_1$ through $AL_3$ and outputted to the output lines $OL_1$ through $OL_8$ have waveforms shown in FIG. 4(*b*). In such a scanning circuit wherein only three address lines $AL_1$ through $AL_3$ are provided, AND circuits $AG_{i1}$ through $AG_{i8}$ are arranged so as to invert inputs where necessary, in order to obtain the output signals described above.

In the scanning circuit shown in FIG. 3 whose decoder 6 is a dynamic type, the address signal is inputted only to the N-type transistors $T_{n1}$ through $T_{n3}$. Therefore, the address lines AL and IAL each have a load capacity $C_{a3}$ equivalent to ½ ($C_a/2$) of that of the conventional scanning circuit. Therefore, the total power consumption $P_{a3}$ is given as:

$$P_{a3}=f_d\times C_{a3}\times V^2=f_dC_aV^2/2=P_a/4$$

It is found that the scanning circuit in this case consumes power equivalent to ¼ of that of the conventional scanning circuit.

On the other hand, in the scanning circuit shown in FIG. 4(*a*), the address lines $AL_1$ through $AL_3$ each are connected to the transistors in each of the AND circuits $AG_{i1}$ through $AG_{i8}$, so as to correspond to the L outputs. Therefore, the load capacity $C_{a4}$ of each address line is two times ($2C_a$) greater than that of the conventional scanning circuit. However, since address lines IAL are unnecessary, the power consumption $P_{a4}$ as a whole is given as:

$$\begin{aligned} P_{a4} &= f_d\times C_{a4}\times V^2\times 1/2=f_d2C_aV^2/2=f_dC_aV^2 \\ &= P_a/2 \end{aligned}$$

Thus, the foregoing scanning circuit has a power consumption equivalent to ½ of that of the conventional scanning circuit.

Furthermore, in the case with a VGA-standard image display apparatus having a data line driving circuit 2 with 640 outputs (therefore, L=640), since m=10, 10 transistors connected in series need to be provided in each AND circuit AG. A decoder composed of such AND circuits AG tends to present a problem that an operational speed lowers. However, by arranging the AND circuits AG as shown in FIG. 5, the problem is solved.

Figure 5:
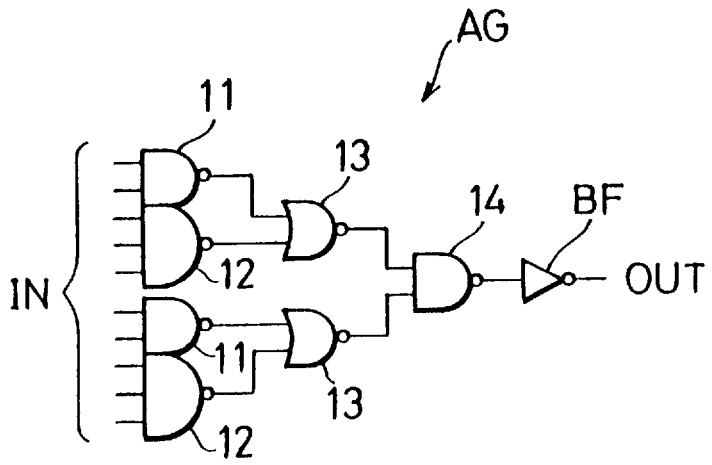
FIG. 5 is a circuit diagram illustrating an arrangement of an AND circuit with 10 inputs provided in the scanning circuit of FIG. 1(*a*) and the scanning circuit of FIG. 4(*a*).

According to the arrangement shown in FIG. 5, 5 inputs are processed by a pair of NAND circuits 11 and 12, and respective outputs of the NAND circuits 11 and 12 are supplied to an NOR circuit 13. An output of the NOR circuit 13, and an output of another group of a pair of NAND circuits 11 and 12 and an NOR circuit 13 are supplied to an NAND circuit 14.

Incidentally, in the case where the scanning circuit in accordance with the present embodiment is adapted to a data line driving circuit 2 of an image display apparatus wherein a liquid crystal panel 1 and the data line driving circuit 2 are integrally provided by using polycrystalline silicon thin film transistors, frequencies of the address signal can be reduced to ½ of the conventional scanning circuit. Therefore, power consumption of the data line driving circuit 2 can be decreased.

Note that though the active matrix-type liquid crystal display apparatus has been taken as an example in the present embodiment, the image display apparatus of the present invention may be any other type, provided that the scanning circuit of the present invention can be adapted to the image display apparatus.

Second Embodiment

Figure 6:
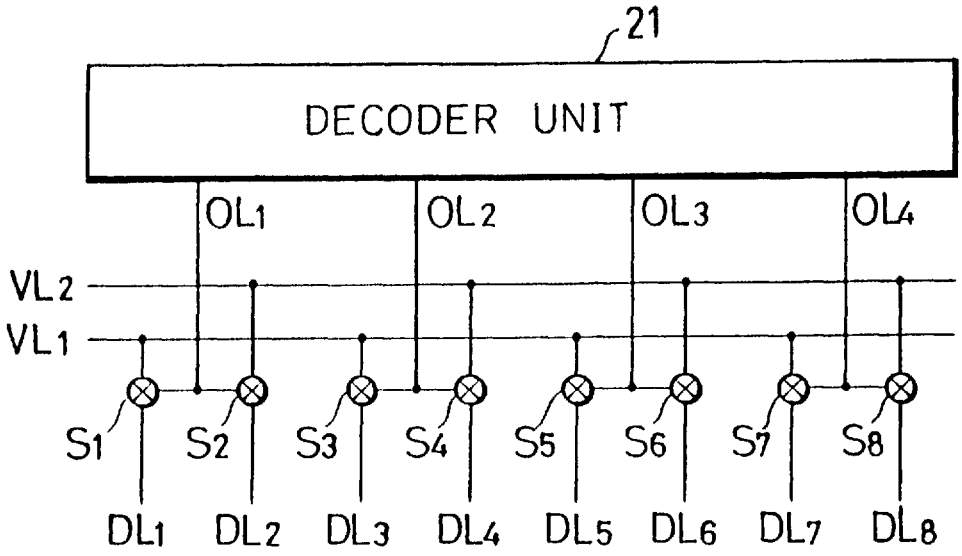
FIG. 6 is a circuit diagram illustrating an arrangement of principal parts of a scanning circuit in accordance with the second embodiment of the present invention.
Figure 7:
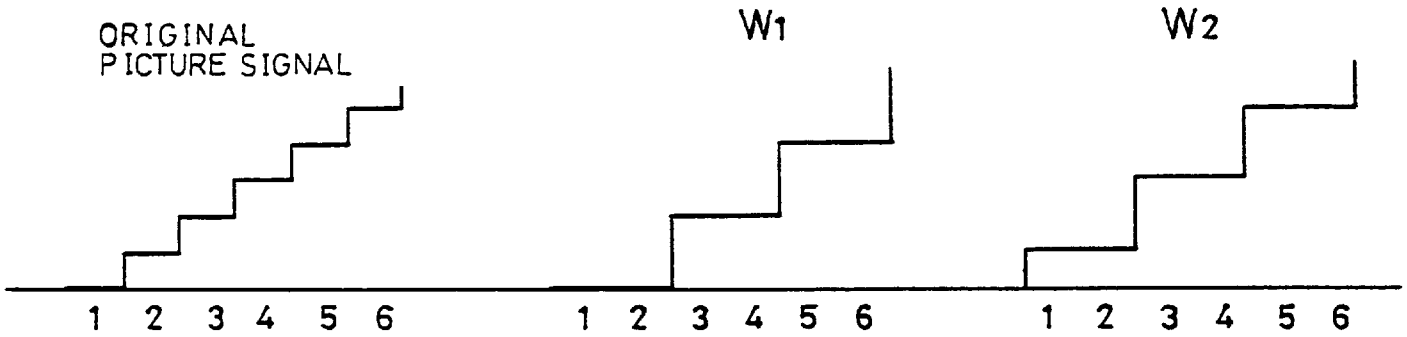
FIG. 7 is a waveform chart illustrating waveforms of picture signals to be inputted to picture lines of the scanning circuit shown in FIG. 6.
Figure 8:
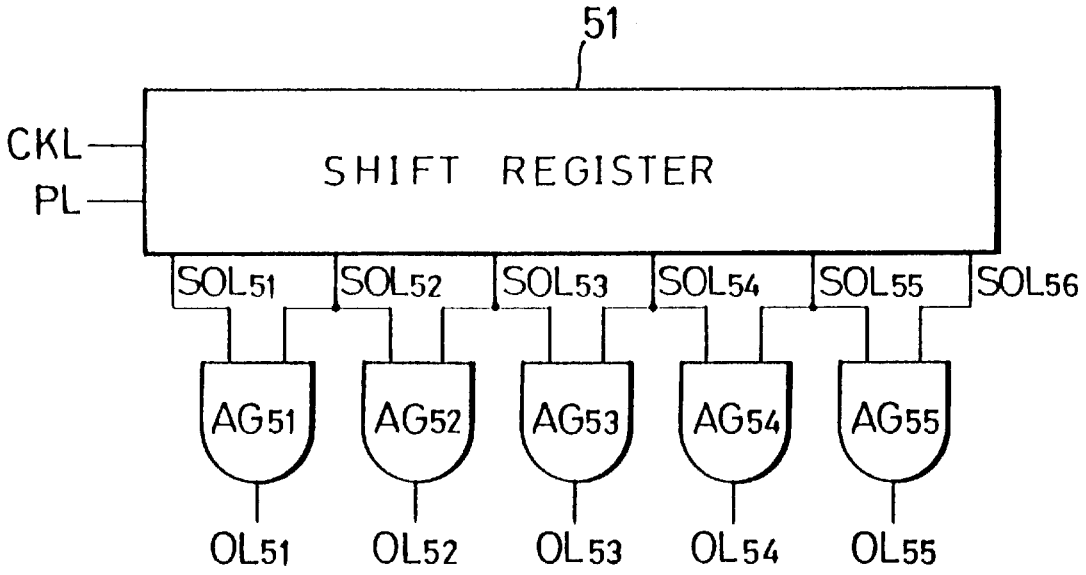
FIG. 8 PRIOR ART
FIG. 8 is a circuit diagram illustrating an arrangement of principal parts of a conventional shift register-type scanning circuit.
Figure 9:
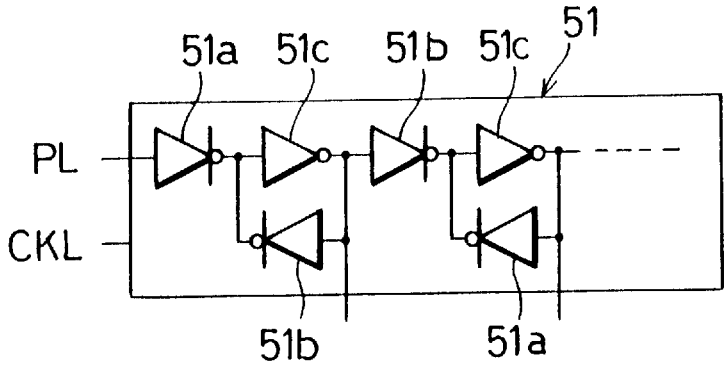
FIG.9 PRIOR ART
FIG. 9 is a circuit diagram illustrating an arrangement of a shift register of the scanning circuit shown in FIG. 8.
Figures 10A, 10B, 10C, 10D, 10E, 10F, 10G, 10H, 10I, 10J, 10K, 10L, 10M, 10N:
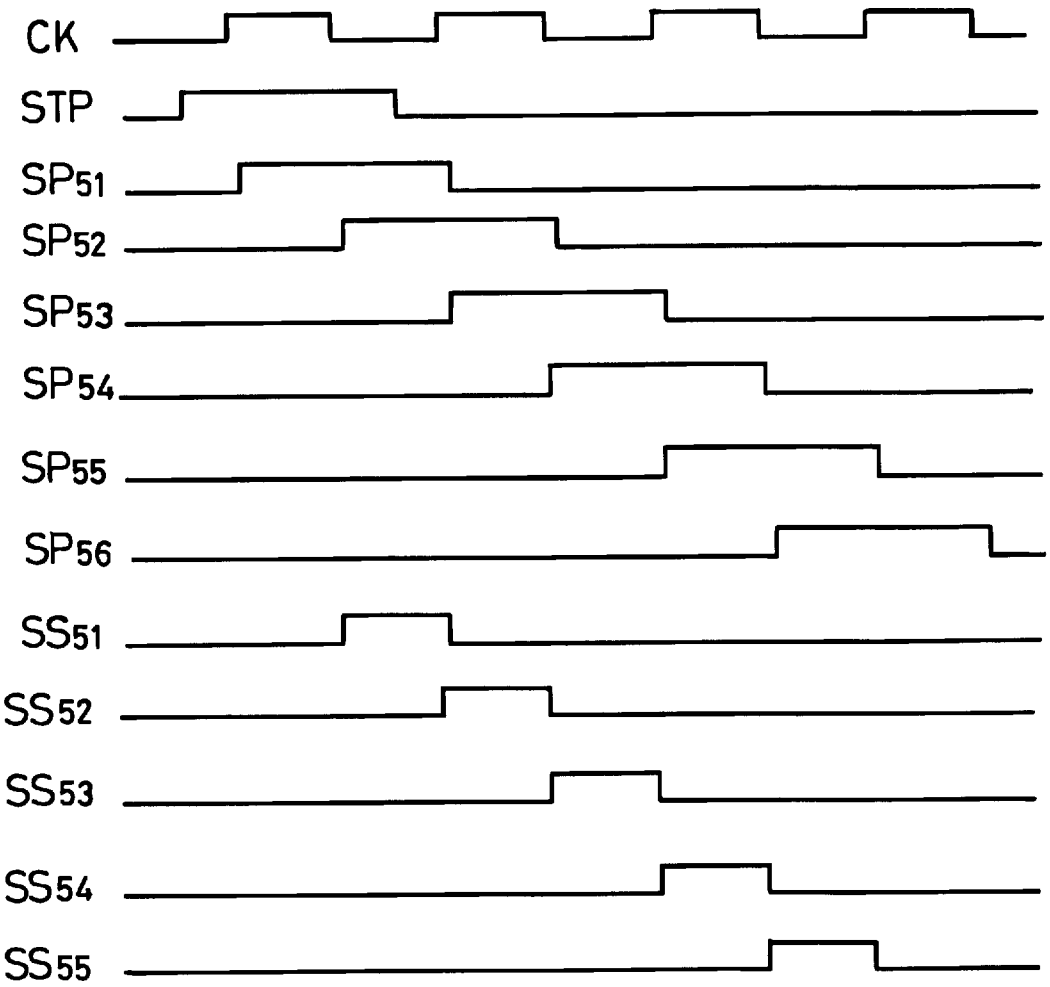
FIG.10(a) (PRIOR ART)
FIG.10(b) (PRIOR ART)
FIG.10(c) (PRIOR ART)
FIG.10(d) (PRIOR ART)
FIG.10(e) (PRIOR ART)
FIG.10(f) (PRIOR ART)
FIG.10(g) (PRIOR ART)
FIG.10(h) (PRIOR ART)
FIG.10(i) (PRIOR ART)
FIG.10(j) (PRIOR ART)
FIG.10(k) (PRIOR ART)
FIG.10(l) (PRIOR ART)
FIG.10(m)(PRIOR ART)
FIG.10(n) (PRIOR ART)
FIG. 10 is a timing chart illustrating operations of the scanning circuit shown in FIG. 8.
Figure 11A:
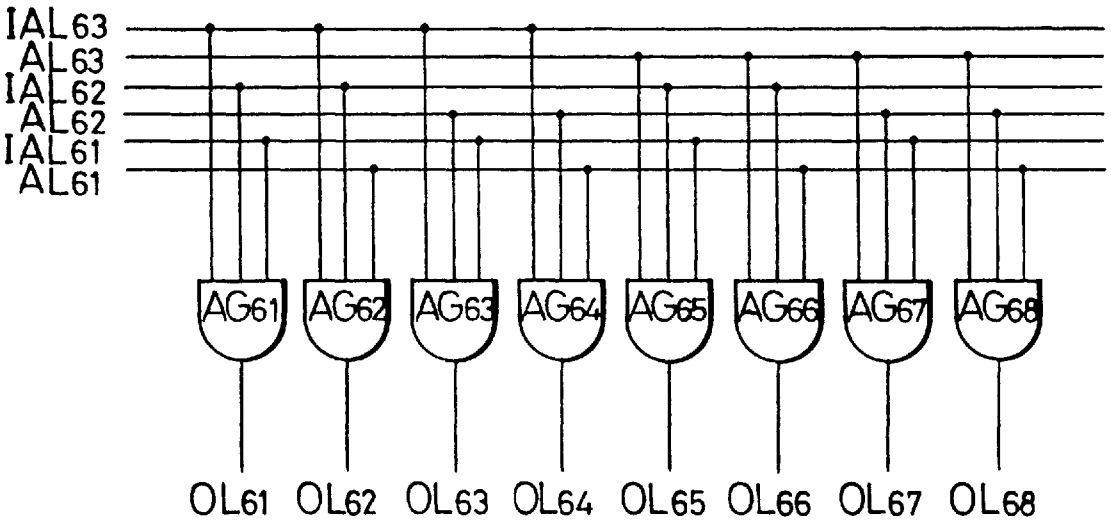
FIG.11(a) PRIOR ART
FIG. 11(*a*) is a circuit diagram illustrating an arrangement of principal parts of a conventional decoder-type scanning circuit.
Figure 12:
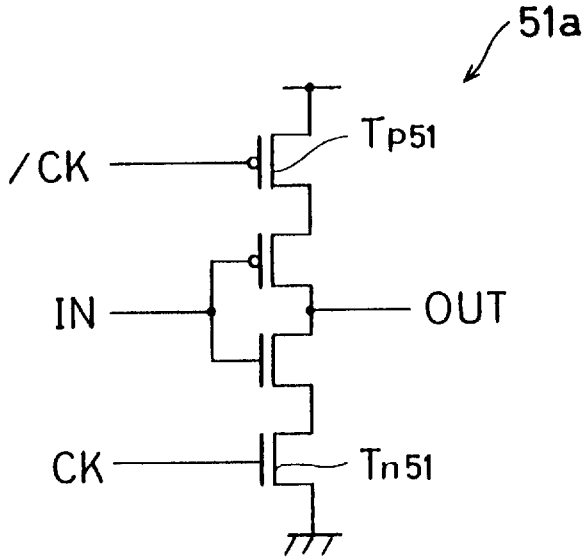
FIG. 12 PRIOR ART
FIG. 12 is a circuit diagram illustrating an arrangement of a clocked inverter in the shift register shown in FIG. 9.
Figure 13:
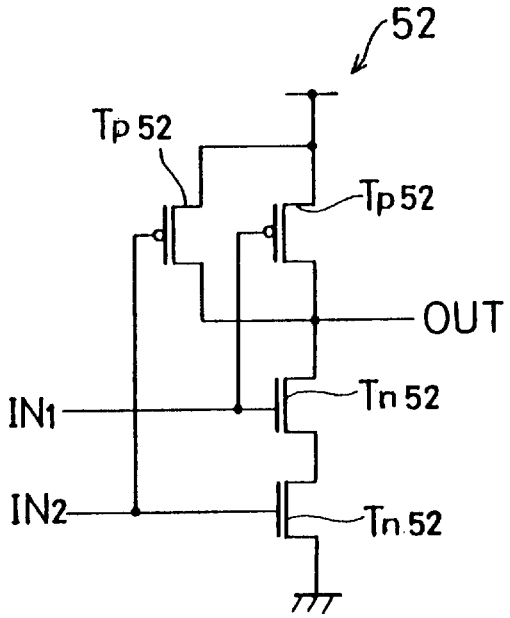
FIG. 13 PRIOR ART
FIG. 13 is a circuit diagram illustrating an arrangement of an NAND circuit composed of CMOS circuits, which is provided in the scanning circuit shown in FIG. 11(*a*).

The following description will discuss another embodiment of the present invention with reference to FIGS. 6 and 7. The members having the same structure (function) as those in the above-mentioned embodiment will be designated by the same reference numerals and their description will be omitted.

A scanning circuit in accordance with the present embodiment is provided with a decoder unit 21, picture lines $VL_1$ and $VL_2$, and sampling circuits $S_1$ through $S_8$, as shown in FIG. 6. The decoder unit 21 has any of the arrangements of FIGS. 1(*a*), 3, and 4 of the first embodiment. The decoder unit 21 in accordance with the present embodiment has four output lines $OL_1$ through $OL_4$.

The sampling circuits $S_1$ and $S_2$, the sampling circuits $S_3$ and $S_4$, the sampling circuits $S_5$ and $S_6$, and the sampling circuits $S_7$ and $S_8$ are connected to the output lines $OL_1$ through $OL_4$ of the decoder unit 21, respectively. In addition, the odd-number'th sampling circuits $S_1$, $S_3$, $S_5$, and $S_7$ are connected to the picture line $VL_1$, while the even-numbered sampling circuits $S_2$, $S_4$, $S_6$, and $S_8$ are connected to the picture line $VL_2$.

To the picture lines $VL_1$ and $VL_2$, division picture signals obtained by dividing an original picture signal are inputted. In the case where the original picture signal has, for example, a staircase waveform as shown in FIG. 7, signals with respective waveforms $W_1$ and $W_2$ are produced from the original picture signal. In the waveform $W_1$, a certain level of the original picture signal is maintained for a period of time twice longer than that of the original picture signal, while in the waveform $W_2$, a level of the original picture signal which is one level upper than the foregoing level is maintained for a period of time twice longer than that of the original picture signal. Therefore, the waveforms $W_1$ and $W_2$ alternately have the levels of the original picture signal, thereby the waveform $W_1$ having every other level and the waveform $W_2$ having the others, and maintain them for the periods respectively twice longer than those of the original picture signal. The signals with the waveforms $W_1$ and $W_2$ thus arranged are inputted to the picture lines $VL_1$ and $VL_2$, respectively.

In the scanning circuit thus arranged, the decoder 21 are supplied with an address signal which has the same combinations of the binary values of the bits as those of the address signal of the scanning circuit in accordance with the first embodiment and whose least significant bit has a frequency ($f_d/8$) equivalent to half of that of the address signal of the first embodiment (see Table 2, and FIGS. 1(*b*) or 4(*b*)). Therefore, a signal (scanning signal) which has a frequency equivalent to half of the dot frequency is supplied to the output lines $OL_1$ through $OL_4$ of the decoder 21. In accordance with the scanning signal, one pair is selected in the pairs of the sampling circuits $S_1$ and $S_2$, the sampling circuits $S_3$ and $S_4$, the sampling circuits $S_5$ and $S_6$, and the sampling circuits $S_7$ and $S_8$. Then, the picture signals from the picture lines $VL_1$ and $VL_2$ are supplied through a pair of the selected sampling circuits S to two data lines DL connected to the sampling circuits S, respectively.

To be more concrete, when the scanning signal is outputted from the output line $OL_1$, the sampling circuits $S_1$ and $S_2$ are selected. Therefore, the picture signal from the picture line $VL_1$ is sampled by the sampling circuit $S_1$, and is outputted to the data line $DL_1$, while the picture signal from the picture line $VL_2$ is sampled by the sampling circuit $S_2$, and is outputted to the data line $DL_2$.

Likewise, when the scanning signal is sequentially outputted from the output lines $OL_2$ through $OL_4$, the sampling circuits $S_3$ and $S_4$, the sampling circuits $S_5$ and $S_6$, and the sampling circuits $S_7$ and $S_8$ are respectively selected. As a result, the picture signal from the picture line $VL_1$ is outputted to the data line $DL_3$, $DL_5$, and $DL_7$, while the picture signal from the picture line $VL_2$ is outputted to the data line $DL_4$, $DL_6$, and $DL_8$.

Thus, since the scanning circuit of the present embodiment has the data lines DL at a rate of two data lines DL per one output line tL of the decoder unit 21, the address signal to be supplied to the decoder 21 has a frequency of ½ of that of the scanning signal wherein the output lines OL and the data lines DL connected thereto are 1:1. Therefore, the address signal for driving the data lines DL has the highest frequency of ⅛ of the dot frequency. With this arrangement, it is possible to lower the driving frequencies without decreasing the number of pixels in the image display apparatus.

Note that here it is set that th e decoder unit 21 has four outputs and the scanning circuit has eight outputs, but the respective numbers of their outputs are not restricted as such. Provided that the decoder unit 21 has L/2 outputs when the number of the outputs of the scanning circuit is L, the "L" may take any number.

In the case where the address signal with m combinations of bit values (m: the number of the address lines) is supplied to the scanning circuit of the present embodiment, the bits (bit signals) of the address signal respectively have frequencies of $f_d/2^3$, $f_d/2^4$, $f_d/2^5$, . . . , $f_d/2^m$, $f_d/2^{m+1}$, and $f_d/2^{m+1}$, from the least significant bit to the most significant bit. Here also, the two bits at the high end have a same frequency and a phase difference of 90° one another.

A load capacity $C_b$ per one address line is the same as that of the conventional scanning circuit of the decoder type, namely, $C_a$. The scanning circuit of the present embodiment, as the conventional scanning circuit, has m address lines, and the same number of inverting address lines. Therefore, power consumption of the scanning circuit $P_b$ is given as:

$$\begin{aligned} P_b &= (f_d/2^3 = f_d/2^4 + f_d/2^5 + \ldots + \\ &\quad f_d/2^m + f_d/2^{m+1} + f_d/2^{m+1})C_bV^2 \times 2 \\ &\approx f_dC_bV^2/2 = f_dC_aV^2/2 = P_a/4 \end{aligned}$$

Therefore, the scanning circuit of the present embodiment consumes power equivalent to ¼ of that of the conventional scanning circuit. In the case where the decoder of the dynamic type (see FIG. 3) of the first embodiment is adapted to the scanning circuit of the present embodiment, the power consumption falls fifty percent. Therefore, the power consumption of the scanning circuit in accordance with the foregoing arrangement becomes ⅛ of that of the conventional scanning circuit.

Incidentally, in the case where the scanning circuit in accordance with the present embodiment is adapted to a data line driving circuit (see FIG. 2(*a*)) of an image display apparatus wherein a liquid crystal panel and the data line driving circuit are integrally provided by using polycrystalline silicon thin film transistors, frequencies of the address signal can also be reduced to ¼ of those of the conventional scanning circuit. Therefore, power consumption of the data line driving circuit can be decreased. According to this arrangement, the sampling circuits $S_1$ through $S_8$ are also composed of polycrystalline silicon thin film transistors.

Note that the number of the divisions of the picture signal, that is, the number of the data lines DL connected to the output lines OL of the decoder unit 21, is not restricted to 2 in the case of the scanning circuit of the present embodiment, but it may be 3, or 4.

The arrangements wherein the scanning circuit is adapted to the data line driving circuit of the matrix-type image display apparatus have been taken as examples for the first and second embodiments of the present invention. But, the present invention is not restricted to these arrangements. The present invention may have an arrangement wherein any of the scanning circuits is adapted to a scanning line driving circuit, or another arrangement wherein it is adapted to another circuit.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A scanning circuit, comprising:

an address signal generator for generating an address signal composed of m bit signals indicative of m bits of the address signal, respectively wherein when the address signal changes, only one bit of the address signal being switched at one time;

m address lines for supplying the bit signals, respectively; and a decoder connected to the address lines so as to sequentially output L scanning signals by conducting logical operations on the address signals, said L being $\leqq 2^m$ and said m being $\geqq 2$.

2. The scanning circuit as set forth in claim 1, wherein:

the bit signal indicative of the least significant bit of the address signal has a frequency of ¼ of a dot frequency, the dot frequency being a reciprocal of a period of time required for reading in data corresponding to a pixel; and the bit signals indicative of two bits at the high end, respectively of the address signal have a same frequency and a phase different of 90° from one another.

3. The scanning circuit as set forth in claim 2, wherein said decoder is composed of thin film transistors.

4. The scanning circuit as set forth in claim 2, wherein said decoder includes L AND circuits, each said AND circuit conducting AND operations on the address signal.

5. The scanning circuit as set forth in claim 4, wherein said decoder is a dynamic-type decoder.

6. A scanning circuit as set forth in claim 2, further comprising first and second sampling circuits for respectively sampling first and second picture signals constituting an original picture signal in response to scanning signals supplied from said decoder, one pair of said first and second sampling circuits being provided per one scanning signal output line.

7. The scanning circuit as set forth in claim 6, wherein said decoder and said first and second sampling circuits are composed of thin film transistors.

8. The scanning circuit as set forth in claim 6, wherein said decoder includes L AND circuits, each said AND circuit conducting AND operations on the address signal.

9. The scanning circuit as set forth in claim 8, wherein said decoder is a dynamic-type decoder.

10. An image display apparatus, comprising:

pixel electrodes for supplying a picture signal to pixels provided in a matrix form;

a plurality of data lines for supplying the picture signal to said pixel electrodes;

a plurality of scanning lines orthogonally crossing said data lines so as to sequentially select said pixel electrodes to be supplied with the picture signal;

a data line driving circuit for outputting the picture signal to said data lines; and a scanning line driving circuit for outputting a selection signal, wherein at least either said data line driving circuit or said scanning line driving circuit includes a scanning circuit, said scanning circuit including:

an address signal generator for generating an address signal composed of m bit signals indicative of m bits of the address signal, respectively wherein when the address signal changes, only one bit of the address signal being switched at one time;

m address lines for supplying the bit signals, respectively; and a decoder connected to the address lines so as to sequentially output L scanning signals by conducting logical operations on the address signal, said L being $\leqq 2^m$ and said m being $\geqq 2$.

11. The image display apparatus as set forth in claim 10, wherein:

the bit signal indicative of the least significant bit of the address signal has a frequency of ¼ of a dot frequency, the dot frequency being a reciprocal of a period of time required for reading in data corresponding to each pixel; and the bit signals indicative of the two bits at the high end, respectively, of the address signal have a same frequency and a phase difference of a 90° from one another.

12. The image display apparatus as set forth in claim 11, wherein said decoder of said scanning circuit including L, AND circuits, each said AND circuit conducting AND operations on the address signal.

13. The image display apparatus as set forth in claim 12, wherein said decoder of said scanning circuit is a dynamic-type decoder.

14. The image display apparatus as set forth in claim 11, wherein said scanning, circuit further includes first and second sampling circuits for respectively sampling first and second picture signals constituting an original picture signal in response to scanning signals supplied from said decoder, one pair of said first and second sampling circuits being provided per one scanning signal output line.

15. The image display apparatus as set forth in claim 14, wherein said decoder of said scanning circuit includes L AND circuits, each said AND circuit conducting AND operations on the address signal.

16. The image display apparatus as set forth in claim 15, wherein said decoder of said scanning circuit is a dynamic-type decoder.

17. An image display apparatus, comprising:

pixel electrodes for supplying a picture signal to pixels provided in a matrix form;

a plurality of data lines for supplying the picture signal to said pixel electrodes;

a plurality of scanning lines orthogonally crossing said data lines so as to sequentially select said pixel electrodes to be supplied with the picture signal;

a data line driving circuit for outputting the picture signal to said data lines, said data line driving circuit including a scanning circuit, said scanning circuit including an address signal generator for generating an address signal composed of m bit signals indicative of m bits of the address signal, respectively, wherein when the address signal changes, only one bit of the address signal being switched at one time, m address lines supplying the bit signals, respectively, and a decoder connected to the address lines so as to sequentially output L scanning signals by conducting logical operations on the address signal, said L being $\leqq 2^m$ and said m being $\geqq 2$, said decoder being composed of thin film transistors;

a scanning line driving circuit for outputting a selection signal; and switching elements for outputting the picture signal supplied from said data lines to said pixel electrodes in accordance with the selection signals supplied to said scanning lines;

wherein said pixel electrodes, said switching elements, and said data line driving circuit are provided on either an amorphous silicon thin film, polycrystalline silicon thin film, or a monocrystalline silicon thin film, formed on an insulating substrate.

18. The image display apparatus as set forth in claim 17, wherein the bit signal indicative of the least significant bit of the address signal has a frequency of ¼ of a dot frequency, the dot frequency being a reciprocal of a period of time required for reading in data corresponding to each pixel; and the bit signals indicative of the two bits at the high end, respectively, of the address signal have a same frequency and a phase difference of 90° from one another.

19. The image display apparatus as set forth in claim 18, wherein said decoder of said scanning circuit includes L AND circuits, each said AND circuit conducting AND operations on the address signal.

20. The image display apparatus as set forth in claim 19, wherein said decoder of said scanning circuit is a dynamic-type decoder.

21. The image display apparatus as set forth in claim 18, wherein said scanning circuit further includes first and second sampling circuits for respectively sampling first and second picture signals constituting an original picture signal in response to scanning signals supplied from said decoder, one pair of said first and second sampling circuits being provided per one scanning signal output line.

22. The image display apparatus as set forth in claim 21, wherein said decoder of said scanning circuit includes L AND circuits, each said AND circuit conducting AND operations on the address signal.

23. The image display apparatus as set forth in claim 22, wherein said decoder of said scanning circuit is a dynamic-type decoder.

24. A scanning circuit, comprising:

an address signal generator for generating an address signal composed of m bit signals indicative of m bits of the address signal, respectively, and m inverted bit signals resulting from inverting the m bit signals, respectively, wherein when the address signal changes, only one bit of the address signal being switched at one time;

2m address lines for supplying the bit signals and the inverted bit signals, respectively; and a decoder connected to the address lines so as to sequentially output L scanning signals by conducting logical operations on m signals selected from among the m bit signals and the m inverted bit signals, said L being $\leqq 2^m$ and said m being $\geqq 2$.

25. The scanning circuit as set forth in claim 24, wherein:

the bit signal indicative of the least significant bit of the address signal has a frequency of ¼ of a dot frequency, the dot frequency being a reciprocal of a period of time required for reading in data corresponding to a pixel; and the bit signals indicative of two bits at the high end, respectively, of the address signal have a same frequency and a phase different of 90° from one another.

26. The scanning circuit as set forth in claim 25, wherein said decoder is composed of thin film transistors.

27. The scanning circuit as set forth in claim 25, wherein said decoder includes L AND circuits, each said AND circuit conducting AND operations on the address signal.

28. The scanning circuit as set forth in claim 27, wherein said decoder is a dynamic-type decoder.

29. A scanning circuit as set forth in claim 25, further comprising first and second sampling circuits for respectively sampling first and second picture signals constituting an original picture signal in response to scanning signals supplied from said decoder, one pair of said first and second sampling circuits being provided per one scanning signal output line.

30. The scanning circuit as set forth in claim 29, wherein said decoder and said first and second sampling circuits are composed of thin film transistors.

31. The scanning circuit as set froth in claim 29, wherein said decoder includes L AND circuits, each said AND circuit conducting AND operations on the address signal.

32. The scanning circuit as set forth in claim 31, wherein said decoder is a dynamic-type decoder.

33. An image display apparatus, comprising:

pixel electrodes for supplying a picture signal to pixels provided in a matrix form;

a plurality of data lines for supplying the picture signal to said pixel electrodes;

a plurality of scanning lines orthogonally crossing said data lines so as to sequentially select said pixel electrodes to be supplied with the picture signal;

a data line driving circuit for outputting the picture signal to said data lines; and a scanning line driving circuit for outputting a selection signal, wher ein at least either said data line driving circuit or said scanning line driving circuit includes a scanning circuit, said scanning circuit including:

an address signal generator for generating an address signal composed of m bit signals indicative of m bits of the address signal, respectively, and m inverted bit signals resulting from inverting the m bit signals, respectively, wherein when the address signal changes, only one bit of the address signal being switched at one time;

2m address lines for supplying the bit signals and the inverted bit signals, respectively; and a decoder connected to the address lines so as to sequentially output L scanning signals by conducting logical operations on m signals selected from among the m bit signals and the m inverted bit signals, said L being $\leqq 2^m$ and said m being $\geqq 2$.

34. The image display apparatus as set forth in claim 33, wherein:

the bit signal indicative of the least significant bit of the address signal has a frequency of ¼ of dot frequency, the dot frequency being a reciprocal of a period of time required for reading in data corresponding to each pixel; and the bit signals indicative of the two bits at the high end, respectively, of the address signal have a same frequency and a phase difference of a 90° from one another.

35. The image display apparatus as set forth in claim 34, wherein said decoder of said scanning circuit including L AND circuits, each said AND circuit conducting AND operations on the address signal.

36. The image display apparatus as set forth in claim 35, wherein said decoder of said scanning circuit is a dynamic-type decoder.

37. The image display apparatus as set forth in claim 34, wherein said scanning circuit further includes first and second sampling circuits for respectively sampling first and second picture signals constituting an original picture signal in response to scanning signals supplied from said decoder, one pair of said first and second sampling circuits being provided per one scanning signal output line.

38. The image display apparatus as set froth in claim 37, wherein said decoder of said scanning circuit includes L AND circuits, each said AND circuit conducting AND operations on the address signal.

39. The image display apparatus as set forth in claim 38, wherein said decoder of said scanning circuit is a dynamic-type decoder.

40. An image display apparatus, comprising:

pixel electrodes for supplying a picture signal to pixels provided in a matrix form;

a plurality of data lines for supplying the picture signal to said pixel electrodes;

a plurality of scanning lines orthogonally crossing said data lines so as to sequentially select said pixel electrodes to be supplied with the picture signal;

a data line driving circuit for outputting the picture signal to said data lines, said data line driving circuit including a scanning circuit, said scanning circuit including an address signal generator for generating an address signal composed of m bit signals indicative of m bits of the address signal, respectively, and m inverted bit signals resulting form inverting the m bit signals, respectively, wherein when the address signal changes, only one bit of the address signal being switched at one time; 2m address lines for supplying the bit signals and the inverted bit signals, respectively; and a decoder connected to the address lines so as to sequentially output L scanning signals by conducting logical operations on m signals selected from among the m bit signals and the m inverted bit signals, said L being $\leqq 2^m$ and said m being $\geqq 2$, said decoder being composed of thin film transistors;

a scanning line driving circuit for outputting a selection signal; and switching elements for outputting the picture signal supplied from said data lines to said pixel electrodes in accordance with the selection signals supplied to said scanning lines;

wherein said pixel electrodes, said switching elements, and said data line driving circuit are provided on either an amorphous silicon thin film, a polycrystalline silicon thin film, or a monocrystalline silicon thin film, formed on an insulating substrate.

41. The image display apparatus as set forth in claim 40, wherein the bit signal indicative of the least significant bit of the address signal has a frequency of ¼ of a dot frequency, the dot frequency being a reciprocal of a period of time required for reading in data corresponding to each pixel; and the bit signals indicative of the two bits at the high end, respectively, of the address signal have a same frequency and a phase difference of 90° from one another.

42. The image display apparatus as set forth in claim 41, wherein said decoder of said scanning circuit includes L AND circuits, each said AND circuit conducing AND operations on the address signal.

43. The image display apparatus as set forth in claim 42, wherein said decoder of said scanning circuit is a dynamic-type decoder.

44. The image display apparatus as set forth in claim 41, wherein said scanning circuit further includes first and second sampling circuits for respectively sampling first and second picture signals constituting an original picture signal in response to scanning signals supplied from said decoder, one pair of said first and second sampling circuits being provided per one scanning signal output line.

45. The image display apparatus as set forth in claim 44, wherein said decoder of said scanning circuit includes L AND circuits, each said AND circuit conducting AND operations on the address signal.

46. The image display apparatus as set forth in claim 45, wherein said decoder of said scanning circuit is a dynamic-type decoder.

* * * * *